United States Patent [19]

Umino et al.

[11] 4,439,653

[45] Mar. 27, 1984

[54] CIRCUIT BREAKER OPERATING APPARATUS

[75] Inventors: Hiroshi Umino, Inagi; Ikuo Takano, Hachiouji, both of Japan

[73] Assignee: Tokyo Shibaura Denki Kabushiki Kaisha, Kawasaki, Japan

[21] Appl. No.: 357,660

[22] Filed: Mar. 12, 1982

[30] Foreign Application Priority Data

Mar. 19, 1981 [JP] Japan ..... 56-38668

[51] Int. Cl.[3] ..... H01H 3/06

[52] U.S. Cl. ..... 200/153 SC; 200/153 G; 200/308

[58] Field of Search ..... 200/153 SC, 153 G, 153 H, 200/308; 335/76; 74/2; 192/46

[56] References Cited

U.S. PATENT DOCUMENTS

| | | | |
|---|---|---|---|
| 3,234,803 | 2/1966 | Caswell et al. | 335/76 X |
| 3,835,275 | 9/1974 | Preuss | 200/153 SC |
| 4,146,765 | 3/1979 | Wilson | 200/153 SC |
| 4,152,561 | 5/1979 | Maier et al. | 200/153 SC X |
| 4,166,205 | 8/1979 | Maier et al. | 200/153 SC X |
| 4,264,796 | 4/1981 | Nelson et al. | 200/153 SC |
| 4,301,342 | 11/1981 | Castonguay et al. | 200/153 SC |

*Primary Examiner*—Stephen Marcus
*Assistant Examiner*—Ernest G. Cusick
*Attorney, Agent, or Firm*—Oblon, Fisher, Spivak, McClelland & Maier

[57] ABSTRACT

A circuit breaker operating apparatus is provided which includes a frame, a rotatable closing shaft attached to the frame, a first member disposed on one end of the closing shaft for rotating the closing shaft only in one direction, a second member disposed on the other end of the closing shaft for rotating the closing shaft only in the same direction as the first member rotates, and alternately with the first member and a closing cam fixedly secured to the closing shaft which rotates pivotally about the closing shaft in the same direction as the closing shaft rotates. The circuit breaker operating apparatus also includes a spring member provided with one end fixedly secured to the frame, the other end, to the closing cam respectively. The closing cam rotates for charging closing energy into the spring member, and rotates also for discharging the closing energy charged within the spring member after having rotated in a specified constant angle. The circuit breaker operating apparatus further includes a linkage provided with one end sliding on the closing cam, a coupling shaft disposed on the frame and coupled to the other end of the linkage, which rotates depending upon the linkage movement effected by rotation of the closing cam, thereby moving movable contacts into open or closed position, and a tripping member which operates in response to a command signal based on occurrence of overcurrent of abnormalities, thereby driving the linkage.

8 Claims, 7 Drawing Figures

CIRCUIT BREAKER OPERATING APPARATUS

BACKGROUND OF THE INVENTION

1. Field of the Invention

This invention relates generally to a circuit breaker operating apparatus and more particularly to a spring operating apparatus to perform a closing operation by virtue of stored spring energy.

2. Description of the Prior Art

In general, circuit breaker operating apparatuses may be classified into such types as solenoid operating types, pneumatic operation types, and spring operating types.

A solenoid operating type utilizing a solenoid coil as an operating energy source is relatively simple in construction. However, it also has disadvantages such as that its actuating energy source requires a larger-capacity power source.

A pneumatic operation type utilizes compressed air as an operating energy source, and has a simple construction, as does the solenoid type. However, this type also has the disadvantage of needing large air compressing facilities for proper operation.

In a spring operating type circuit breaker, closing energy is stored within a spring assembly by means of manual or electric motor-driven operation, and the spring-stored energy is discharged to complete the closing operation. This type features the advantage that a larger power source is not required for operation, so that such circuit breakers can conserve energy and also can be constructed of a relatively small size.

However, spring-stored closing energy tends to decrease in the process of closing, so that the stored energy becomes insufficient to supply the required closing energy during the final period of a closing operation. Thus, some appropriate mechanism is required to supplement the spring-stored energy.

This requires a more sophisticated and complex construction as compared with other two types, resulting in disadvantages such as that the circuit breakers become susceptible to failure and are lower in reliability.

Therefore, provided a simplified construction is achieved in a spring operating type circuit breaker, such a circuit breaker would be most appropriate for energy conservation. Moreover, since the spring operating type circuit breaker has a mechanism such that a closing operation is performed after having charged a spring assembly with initial closing energy, the breaker may provide such advantages that the breaker can be operated either by manual or motor-driven operation, and that constant and rapid closing speed are available in a closing operation.

SUMMARY OF THE INVENTION

Accordingly, one object of this invention is to provide a circuit breaker operating apparatus having a simplified construction, and high reliability.

It is another object of this invention to provide a circuit breaker operating apparatus interchangeable with other types of circuit breakers with little modification, by virtue of a readily rearrangeable member assembly.

It is another object of this invention to provide a circuit breaker operating apparatus capable of charging closing energy by means of either manual or motor-driven operations which are interchangeable so as not to obstruct one with another.

It is a further object of this invention to provide a circuit breaker operating apparatus capable of a closing operation with no error by confirming the state of spring-stored energy.

Briefly, in accordance with one aspect of this invention, a circuit breaker operating apparatus is provided which includes a frame, a rotatable closing shaft attached to the frame, a first member disposed on one end of the closing shaft for rotating the closing shaft only in one direction, a second member disposed on the other end of the closing shaft for rotating the closing shaft only in the same direction as the first member rotates, and alternately with the first member, and a closing cam fixedly secured to the closing shaft which rotates pivotally about the closing shaft in the same direction as the closing shaft rotates. The circuit breaker operating apparatus also includes a spring member provided with one end fixedly secured to the frame and the other end secured to the closing cam. The closing cam rotates for charging closing energy into the spring member and rotates also for discharging the closing energy charged within the spring member after having rotated a specified angle. The circuit breaker operating apparatus further includes a linkage provided with one end sliding on the closing cam, a coupling shaft disposed on the frame and coupled to the other end of the linkage, which rotates depending upon the linkage movement effected by rotation of the closing cam, thereby moving movable contacts into open or closed position, and a tripping member which operates in response to a command signal based on occurrence of overcurrent or abnormalities, thereby driving the linkage. In the circuit breaker operating apparatus the closing cam causes the spring member to discharge closing energy charged therein due to rotation of the closing cam by a specified constant angle and permits the rotation of the coupling shaft in one direction through the linkage, thereby moving movable contacts into closed position, and the tripping member causes, through the linkage, the coupling shaft to rotate in the other direction opposite to that of closing operation, thereby moving movable contacts into the open position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
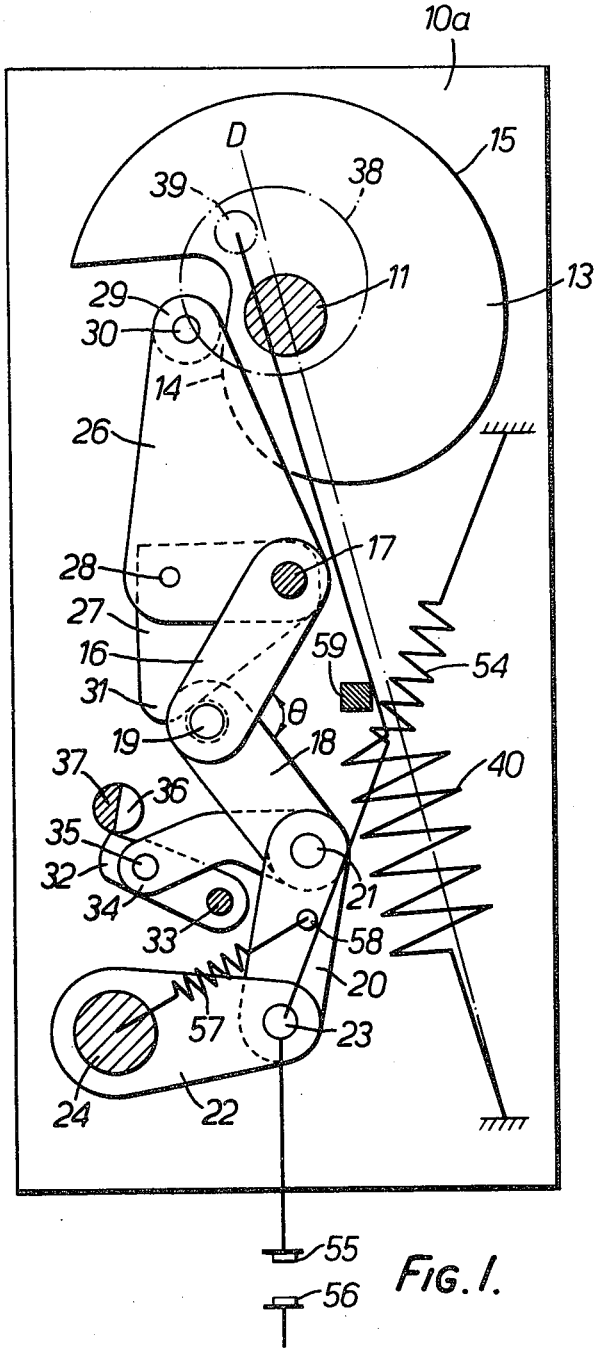
FIG. 1 is a right side view illustrating a circuit breaker operating apparatus with the contacts in open position according to the present invention.
Figure 2:
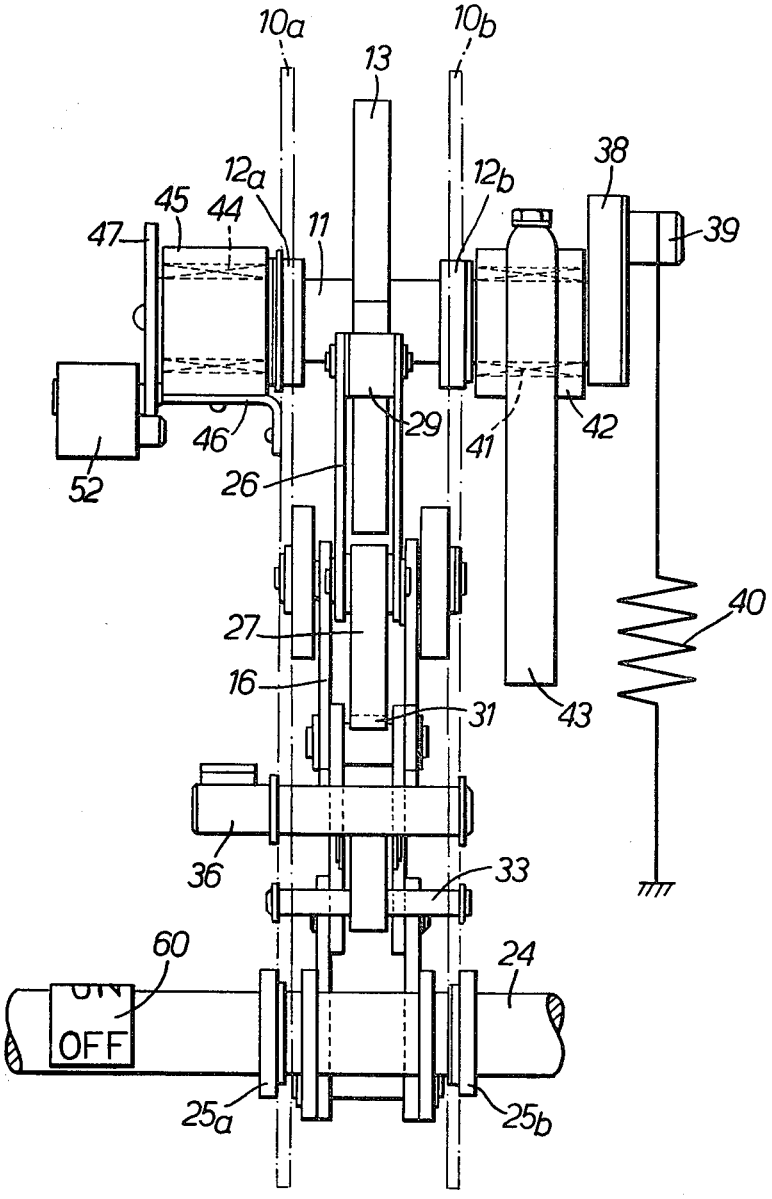
FIG. 2 is an elevational view of the apparatus of FIG. 1.

Referring now to the drawings, wherein like reference numerals designate identical or corresponding parts throughout the several views, and more particularly to FIGS. 1 and 2 thereof, reference numerals 10*a* and 10*b* designate a pair of frames disposed in spaced parallel arrangement. The frames 10*a* and 10*b* are metallic plates having sufficient strength to support an operating mechanism.

Reference numeral 11 designates a closing shaft passing substantially horizontally through frames 10*a* and 10*b*, and rotatably supported, by means of bearings 12*a* and 12*b*, by the frames 10*a* and 10*b*. The closing shaft 11 is provided with a closing cam 13 fixedly secured thereto at the center portion with respect to the frames 10*a* and 10*b*.

The cam surface of the closing cam 13 is formed by the combination of two curved portions. Lower cam surface 14 possesses a steep radial slope and higher cam surface 15 maintains a constant distance from the pivotal center of the closing shaft 11.

Reference numeral 16 designates a first link which has one end rotatably supported by a pin member 17 fixedly secured to intermediate portions of the frames 10*a* and 10*b*. One end of a second link 18 is rotatably coupled through a coupling pin member 19 to the other end of the first link 16. One end of a third link 20 is rotatably coupled through a coupling pin member 21 to the other end of the second link 18. Further, one end of a fourth link 22 is rotatably coupled through a coupling pin member 23 to the other end of the third link 20.

Reference numeral 24 designates a coupling shaft, which extends at a right-angle with respect to the fourth link 22, passes substantially horizontally through lower portions of the frames 10*a* and 10*b*, and is rotatably supported by bearings 25*a* and 25*b* disposed on the frames 10*a* and 10*b*. The other end of the fourth link 22 is rigidly secured to the coupling shaft 24.

Reference numerals 26 and 27 designate two driving links, which are integrally connected by a pin member 28, and are rotatably supported by the pin member 17. A roller 29 which rolls in contact with the surface of the cam 13 is attached to one end of the driving link 26 by a pin member 30. The driving link 27 is provided with a projection 31 at one end, and the projection 31 opposes the coupling pin 19 which couples the first link 16 and the second link 18. As the roller 29 gradually rolls from the lower cam surface 14 up to the higher cam surface 15, the driving link 27 rotates about the pin member 17 in a counterclockwise direction, causing the projection 31 to press the coupling pin 19.

Reference numeral 32 designates a trip catch member, one end of which is rotatably secured to a pin member 33 fixedly secured between the frames 10*a* and 10*b*. The intermediate section of the trip catch member 32 is rotatably connected, through a link 34 and a connecting pin 35, to the coupling pin member 21 which couples the second link 18 and the third link 20. Reference numeral 36 designates a trip shaft rotatably secured between the frames 10*a* and 10*b*, and provided with a semicircular-shaped cross section 37. The semicircular-shaped cross section 37 is engaged with the distal end of the trip catch member 32. This engagement is released by rotation of shaft 36 in response to a trip command signal from an external circuit.

Reference numeral 38 designates a spring engaging link, which is fixedly secured to one end of the closing shaft 11, and which is provided with a pin member 39 rotating about the closing shaft 11 as the shaft 11 rotates.

Reference numeral 40 designates a closing spring having one end engaged with the pin member 39 of the link 38, and the other end engaged with a fixed member which is fixed with respect to the frames 10 and 10*b*. The closing spring 40 is stretched when the pin 39 moves upwardly with respect to the closing shaft 11, and thus stores closing energy.

Reference numeral 41 designates a roller clutch disposed on one end of the closing shaft 11. A manual drive handle 43 is fixedly secured to a case 42 of the roller clutch 41. By virtue of the roller clutch 41, the rotation of the drive handle 43 about the closing shaft 11 is imparted to the closing shaft 11 in only one direction.

On the other hand, another roller clutch 44 is disposed on the other end of the closing shaft 11. A case 45 of the roller clutch 44 is supported by a supporting plate 46 fixedly secured to the frame 10*a*. The roller clutches 41 and 44 permit free rotation in the same rotational direction with respect to the closing shaft 11.

Figure 3:
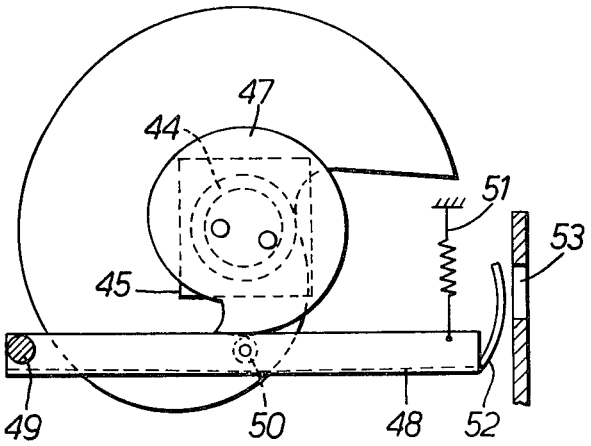
FIG. 3 is a left side view illustrating an indicator indicating the state of spring-stored energy according to the present invention.
Figure 4:
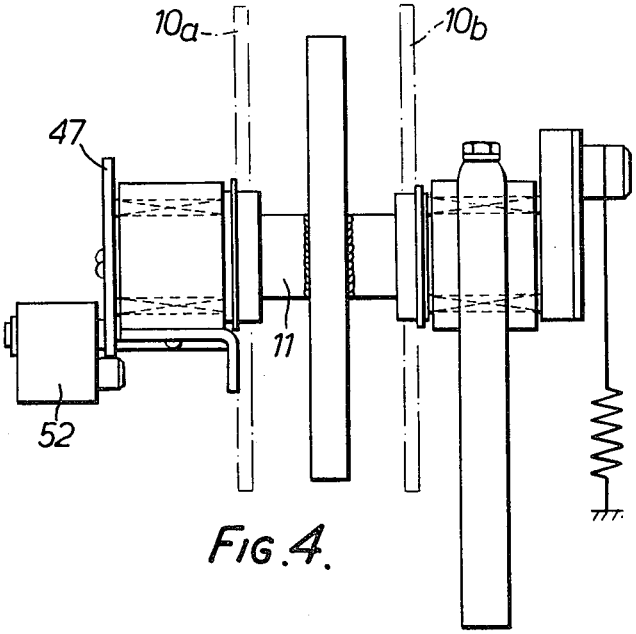
FIG. 4 is an elevation view of the indicator of FIG. 3.

Referring now to FIGS. 2, 3 and 4, reference numeral 47 designates a cam member for use as an indicator. The cam 47 is fixedly secured to one end of the closing shaft 11 and rotates integrally with the closing shaft 11. Reference numeral 48 designates a stored energy indicator having one end rotatably supported by the frame 10*a* by means of a pin member 49. On the center portion of the stored energy indicator 48, there is provided a roller pin member 50 which slidably moves along on the cam surface of the cam member 47. Reference numeral 51 designates a spring member which pulls the stored energy indicator 48 toward the cam member 47. Reference numeral 52 designates a stored energy indicating plate, which rotates pivotally about the pin member 49 for indicating through an indicating window 53 when the roller pin member 50 falls into a concave portion of the cam member 47 due to the tension of the spring 51. This indication may be made by a variation in color.

Referring now back to FIG. 1, reference numeral 54 designates a tripping spring member having one end connected to the frame 10*a*, and the other end engaged to a member (not shown) disposed on the coupling shaft 24 in such a manner that the fourth link 22 is always biased for rotation in a counterclockwise direction about the coupling shaft 24. Reference numeral 55 designates a movable contact of the circuit breaker. The movable contact 55 moves upwardly or downwardly depending upon the rotation of the coupling shaft 24. Reference numeral 56 designates a stationary contact which cooperates with the movable contact 55 disposed in opposition thereto in order to open or close the circuit.

Although only a pair of contacts in one phase of the three-phase circuit breaker are illustrated in FIG. 1, the other phases are provided with pairs of movable and stationary contacts as well. However, the operating apparatus shown in FIGS. 1 and 2 is utilized in common with all three phases, and is generally disposed in the position of the center phase.

Reference numeral 57 designates a link-returning spring having one end engaged with the coupling shaft 24, and the other end engaged with a pin 58 disposed at the center portion of the third link 20. Reference numeral 59 designates a stop member fixedly mounted between the frames 10*a* and 10*b* so as to stop the first link 16. The stop member 59 is disposed at such a position that when the pin member 17 and the coupling pin members 19 and 21 are all arranged in a straight line, a slight clearance is established between the stop member 59 and the first link 16. Reference numeral 60 (FIG. 2) designates an ON-OFF indicating plate disposed on the shaft surface of the coupling shaft 24.

The operation of the above-described circuit breaker operating apparatus will now be explained. Referring now to FIGS. 1 and 2, the movable contact 55 and the stationary contact 56 are in open position. When the drive handle 43 is rotated toward the observer, this causes the closing shaft 11 to rotate in a clockwise direction through the roller clutch 41. But when the handle 43 is rotated away from the observer, in order to return it to its original position, the meshing of the case 42 of roller clutch 41 with the closing shaft 11 is released and the handle 43 alone returns to its original position. In this case, the spring force of the closing spring 40 acts upon the closing cam 13 through the closing shaft 11. The acting direction of this spring force is counterclockwise, opposite to the direction in which the closing shaft 11 is rotated by the handle 43. Thus, the closing shaft 11 is biased for reverse rotation for returning to its original position. However, such is prohibited by the roller clutch 44 disposed on the other end of the closing shaft 11.

As described above, the operating force on the manual drive handle 43 is imparted to the closing shaft 11 while the two roller clutches 41 and 44 function alternately to rotate the closing shaft 11 in only one direction.

Such a simplified construction, wherein the roller clutches 41 and 44 are disposed on the end of the closing shaft 11, permits the circuit breaker to be smaller in size, lower in the occurrence of failure and thus higher in reliability.

Reciprocal operations of the manual drive handle 43 with angles from 20° to 30° in several repetitions permit the closing shaft 11 to rotate in the clockwise direction, and this causes the closing cam 13 to also rotate in clockwise direction. While the closing cam 13 rotates in the clockwise direction, the closing spring 40 is stretched to gradually charge a spring force which serves later to provide closing energy.

The closing spring 40 has a dead point such that when an axial line (designated by reference character D) between the pin member 39 and the fixed point of the closing spring 40 passes over the center point of the closing shaft 11, the charged spring force is rapidly discharged. Therefore, when the closing spring 40 passes over the dead point line D, the closing cam 13 will rotate in the clockwise direction due to the discharging of spring energy. For such rotation, the clutches 41 and 44 are in a free state with respect to the closing shaft 11, so that rotation of the closing shaft 11 and the closing cam 13 is not prohibited.

The rotation of the closing cam 13 causes the roller pin 29 of the free link 26 to rapidly roll from the lower cam surface 14 to the higher cam surface 15. This causes the driving links 26 and 27 to rotate in the counterclockwise direction about the pin member 17, which in turn causes the projection 31 of the driving link 27 to press toward the right coupling pin member 19 connected between the first and the second links 16 and 18. Since one end of the first link 16 is supported by the pin member 17 fixedly secured to the frames 10*a* and 10*b*, the first link 16 and the second link 18 are moved so as to be arranged in a straight line when the coupling pin member 19 is pressed toward the right side. In this state, the roller 29 attached to the driving link 26 has proceeded from the lower cam surface 14 up to the higher cam surface 15. Immediately after the roller pin 29 has completely rolled from the lower cam surface 14 up to the higher cam surface 15, the coupling pin member 19 is moved slightly further toward the right side as described below.

Figure 5:
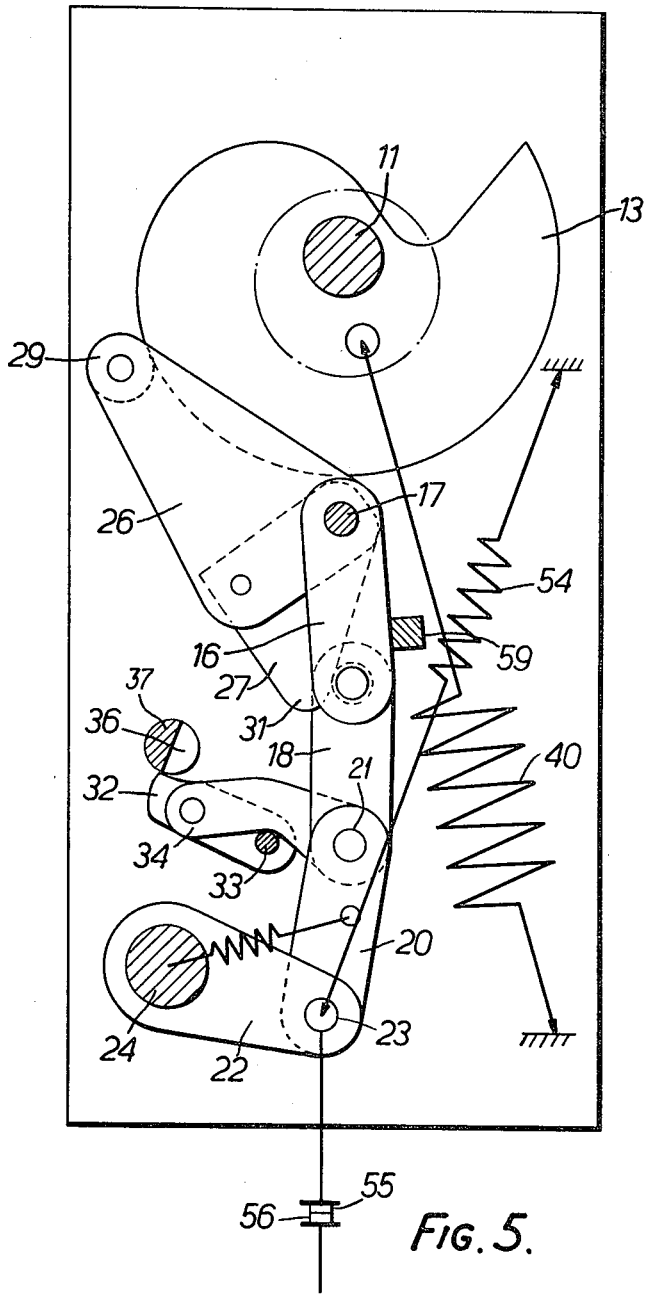
FIG. 5 is a right side view illustrating a circuit breaker operating apparatus with the contacts in closed position according to the present invention.

As the first link 16 and the second link 18 increase their intersecting angle $\Theta$ (shown in FIG. 1) to a value greater than 180°, they are turned over center, and by virtue of the spring force of the tripping spring member 54, are moved to a position at which they are stopped by the stop member 59 as shown in FIG. 5.

The movement during the period from the time when the first link 16 and the second link 18 are aligned to the time when they are stopped by the stop member 59 is made not by pressure of the projection 31 of the free link 27, but only by the spring force of the tripping spring member 54.

Therefore, during the initial closing operation, rapid closing is made by virtue of large closing energy stored within the closing spring 40. However, at the time when the first link 16 collides against the stop member 59 to be stopped, the large spring force of the closing spring 40 is not applied to these members, resulting in the prevention of mechanical damage.

In the position of FIG. 5, the fourth link 22 is depressed downwardly by the third link 20 through the coupling pin member 23, so that the coupling shaft 24 has rotated in the clockwise direction. This rotation of the coupling shaft 24 moves the movable contact 55 of each phase downwardly into closed position with respect to the stationary contact 56, and the closing of the circuit breaker is completed as shown in FIG. 5.

The closing cam 13 and the first link 16 are arranged such that closing energy is mutually imparted between these members through the driving links 26 and 27, which are rotatable about the pin member 17. Therefore, when designing the apparatus, the position of the closing shaft 11 may be determined arbitrarily with no need for modification of linkage but only a variation of the shape of the free driving links 26 and 27.

This is extremely important in case there is a limitation in the height of the operating apparatus.

When the closing shaft 11 is rotated by the operation of the manual drive handle 43, the closing shaft 11 causes the indicating cam 47 to rotate. When the closing spring 40 has stored sufficient energy, by the operation of the manual drive handle 43, that only a single stroke is left prior to the dead point D, the roller pin member 50 attached to the stored energy indicator 48 falls into the concave-like portion of the indicating cam member 47 by the effect of the tension of the spring 51. This causes the stored energy indicating plate 52 to rotate in the counterclockwise direction about the pin member 49, which is indicated in color through the indicating window 53. Thus, the stored energy indicating plate 52 can inform the operator whether the energy stored within the closing spring is optimum, i.e. a single stroke prior to the dead point D.

Therefore, when the operator attempts a check of timing for optimum closing, or when ceasing a closing operation for some reason, the operator may carry out a secure closing operation with no error and appropriate timing by virtue of his ability to confirm the energy stored within the closing spring 40.

Figure 6:
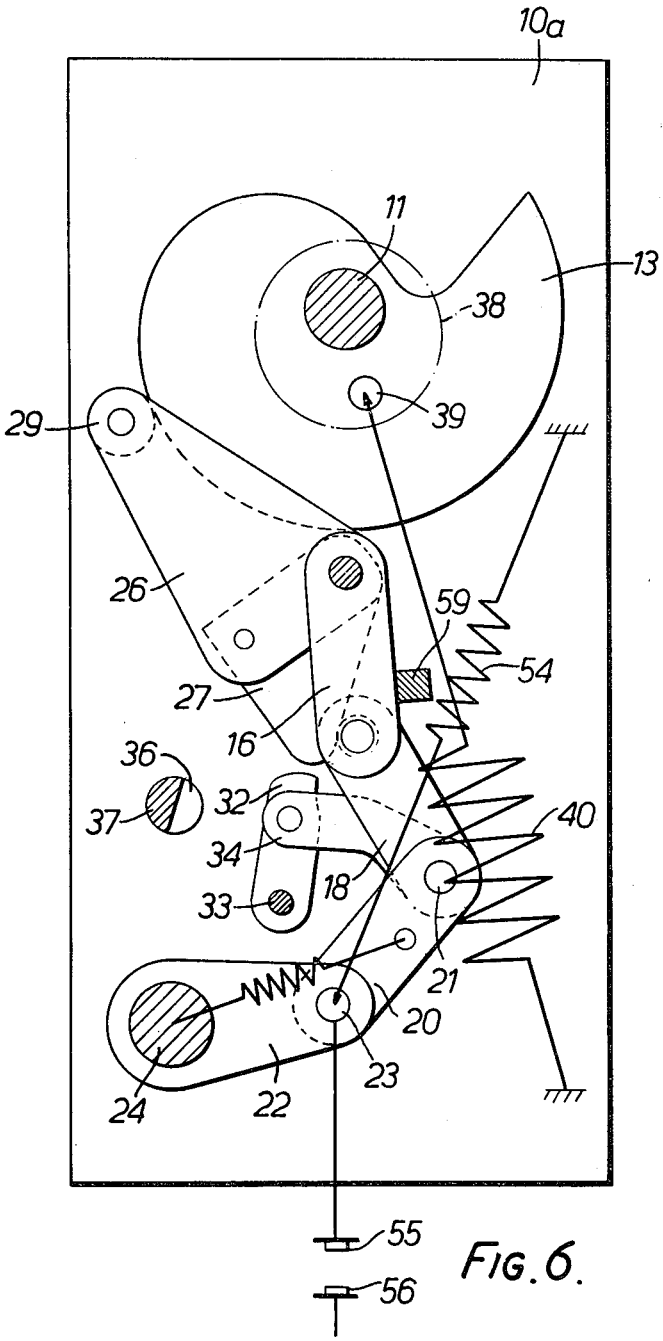
FIG. 6 is a right side view illustrating a circuit breaker operating apparatus in a tripped position according to the present invention.

Next, the tripping operation will be described referring to the circuit breaker with the contact in a closed position as shown in FIG. 5. When overcurrent such as a current due to an abnormality flows into the main circuit through the movable and stationary contacts 55 and 56, the tripping shaft 36 rotates in response to a signal from the circuit. The rotation of the tripping shaft 36 releases the engagement of the semicircular cross section 37 with the trip catch member 32. Since the spring force of the tripping spring 54 stored in the process of the above-described closing operation is applied to the third link 20, the released coupling pin members 21 and 23 are moved to a position as shown in FIG. 6. The coupling pin member 23 is pulled upwardly by the tripping spring 54, so that the coupling shaft 24 is rotated through the fourth link 22 in counterclockwise direction, thereby moving the movable contact 55 into open position with respect to the stationary contact 56, which in turn, completes the tripping operation.

Figure 7:
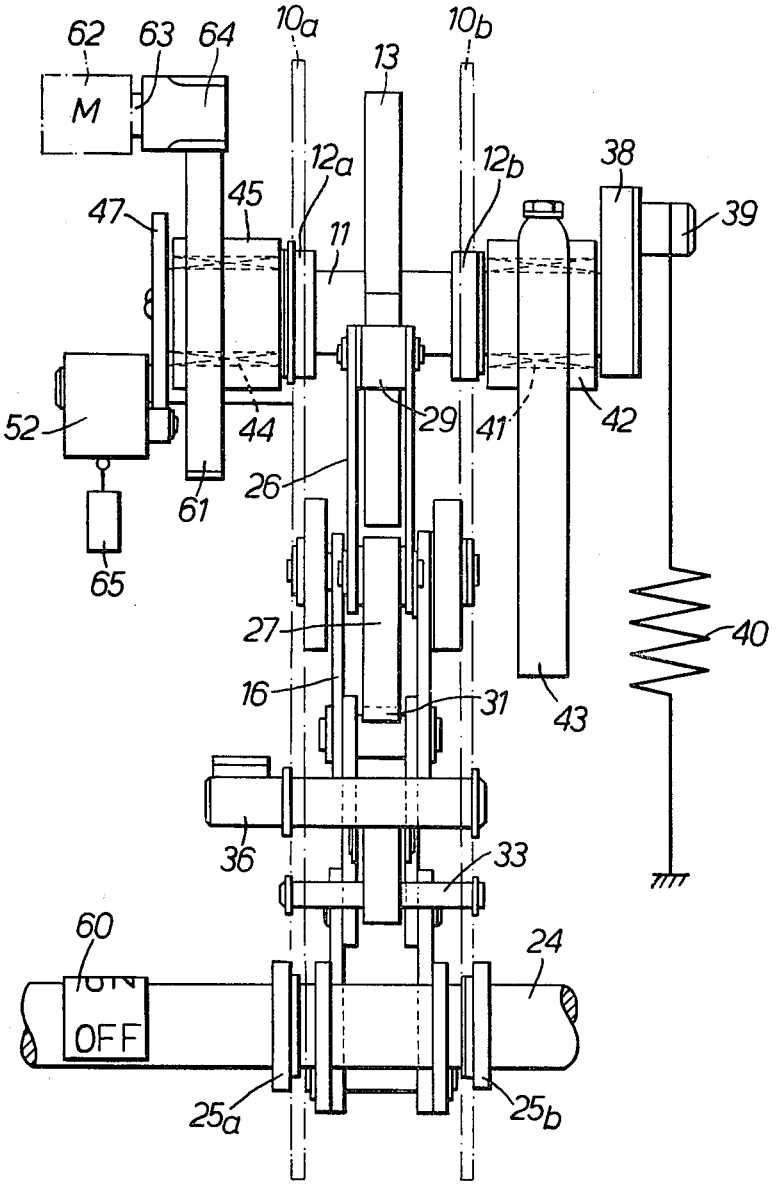
FIG. 7 is a right side view illustrating a circuit breaker apparatus with the manual drive handle and electric motor attached thereto according to the present invention.

FIG. 7 illustrates the construction of a circuit breaker operating apparatus with a manual drive handle and an electric motor which can be utilized alternately. The manual drive handle 43 is attached to one end of the closing shaft 11 through the roller clutch 41. To the other end of the closing shaft 11 is disposed the other roller clutch 44. The case 45 of the roller clutch 44 is rigidly secured to the gear 61. Reference numeral 62 designates an electric motor for use in electric motor-driven operation. The gear shaft 64 is connected to the output shaft 63 of the electric motor 62, and this gear shaft 64 is meshed with the gear 61. The roller clutches 41 and 44 are respectively rotatable in the same direction with respect to the closing shaft 11. Reference numeral 65 designates a limit switch which electrically detects the state of stored energy by detecting the movement of the stored energy indicator 48 when the closing spring 40 stores energy such that only a single stroke is left prior to the dead point D.

In manual operation, power supply to the electric motor 62 is interrupted. The manual drive handle 43 can then be operated to rotate the closing shaft 11 and closing cam 13, thereby charging the closing spring 40 with closing energy. In this case, the electric motor 62 serves as a load through the other clutch 44 with respect to a return force applied to closing shaft 11 and closing cam 13, so that the movement attempted by such a return force is prohibited.

In electric motor-driven operation, energized electric motor 62 continuously rotates the closing shaft 11 and closing cam 13 through the gear shaft 64, the gear 61 and the roller clutch 44, and charges the closing spring 40 with closing energy. In this case, the rotational direction of the closing shaft 11 is the same as that of the roller clutch 41, so that rotational force is not imparted to the manual drive handle 43. When closing energy is charged within the closing spring 40 by the drive of the electric motor 62 such that only a single stroke is left prior to the dead point D, the movement of the stored energy indicator 48 is detected by means of the limit switch 65, thereby confirming that the closing time is immediately prior to the optimum closing, thus stopping the electric motor 62. Provided there is no obstruction for successive closing operations, the electric motor 62 can be reenergized to complete closing.

In effect, after completion of the first closing, in order to shorten the closing time required, closing energy is charged up to the amount such that only a single stroke is left prior to the dead point D. To achieve this, it is effective to detect the state of the stored energy within the closing spring 40 immediately prior to closing. Closing and tripping operations of this circuit breaker are identical with that of the embodiment shown in FIG. 1.

As the manual drive handle 43 is disposed on one end of the closing shaft 11 through the roller clutch 41, and on the other end of the closing shaft 11, the electric motor 62 is disposed through the roller clutch 44. This permits the circuit breaker to readily switch to manual or motor-driven operation as circumstances require. Since the roller clutches 41 and 44 are identical with each other in rotatable direction and intermittent operations are alternately made, manual or motor-driven operations function so as not to prohibit respective rotations.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit breaker operating apparatus, comprising:

(a) a frame;

(b) a rotatable closing shaft attached to said frame;

(c) first means disposed on one end of said closing shaft for rotating said closing shaft only in one direction;

(d) second means disposed on the other end of said closing shaft for rotating said closing shaft only in said one direction, and alternately with said first means;

(e) a closing cam secured to said closing shaft for rotation therewith;

(f) spring means having one end secured to said frame and another end secured to said closing cam at a point spaced from said closing shaft, whereby the rotation of said closing cam up to a specified angle charges closing energy within said spring mean and rotation of said closing cam beyond said specified angle discharges closing energy charged within said spring mean;

(g) a linkage having one end operatively associated with said closing cam for movement in response to the rotation of said closing cam in a first direction;

(h) a coupling shaft disposed on said frame and coupled to the other end of said linkage for rotation in a first direction in response to rotation of said closing cam in said first direction;

(i) tripping means operating in response to a command based upon occurrence of overcurrent or abnormalities, said tripping means operatively connected to said coupling shaft such that operation of said tripping means rotates said coupling shaft in a second direction, opposite to said first direction; and (j) contacts movable between an open and a closed position in response to rotation of said coupling shaft, said contacts being closed by rotation of said coupling shaft in said first direction and opened by rotation of said coupling shaft in said second direction; whereby;

(k) rotation of said closing cam beyond said specified angle causes said spring means to discharge closing energy charged therein, causing said coupling shaft to rotate in said first direction, thereby moving said contacts into the closed position, and (l) operation of said tripping means causes said coupling shaft to rotate in said second direction, thereby moving said contacts into the open position.

2. A circuit breaker operating apparatus as recited in claim 1, further comprising:

an electric motor connected to the other end of said closing shaft through said second means, said electric motor rotating said closing shaft and said closing cam to cause said spring means to charge closing energy.

3. A circuit breaker operating apparatus as recited in claim 1 or 2, further comprising:

indicating means driven by rotation of said closing shaft for indicating that said spring means has charged closing energy therein.

4. A circuit breaker operating apparatus as recited in claim 3 wherein said indicating means comprises:

(a) an indicating cam secured to said closing shaft for rotation therewith;

(b) a stored energy indicator having one end pivotably supported on said frame; and (c) a cam follower carried by said stored energy indicator and operatively associated with said indicating cam, whereby rotation of said closing shaft causes pivotal movement of said stored energy indicator, which movement is related to the amount of charged closing energy in said spring means.

5. A circuit breaker operating apparatus as recited in claim 1 or 2 wherein said first means includes a roller clutch attached to said closing shaft, and a manual drive handle attached to said roller clutch whereby, movement of said manual drive handle in one direction is imparted through said roller clutch to said closing shaft, whereas movement of said manual drive handle in the other direction is not imparted through said roller clutch to said closing shaft.

6. A circuit breaker operating apparatus as recited in claim 5 wherein said second means includes a roller clutch attached to said closing shaft and a support member for supporting said roller clutch whereby, said second means permits rotation of said closing shaft only without rotation of said first means.

7. A circuit breaker operating apparatus as recited in claim 1 wherein said tripping means is coupled to said linkage and motion of said linkage caused by operation of said tripping means causes said coupling shaft to rotate in said second direction.

8. A circuit breaker operating apparatus as recited in claim 1 or 2 wherein said linkage includes:

(a) a driving link member operatively associated with said closing cam and pivotably supported by a pin member secured to said frame and (b) a link chain having one end pivotably supported by said pin member and the other end coupled to said coupling shaft, whereby rotation of said closing cam causes said driving link member to rotate pivotally about said pin member and to press said link chain, thus rotating said coupling shaft in said first direction and moving said contacts into the open position.

* * * * *